US008201661B1

(12) United States Patent
O'Connell, Sr.

(10) Patent No.: US 8,201,661 B1
(45) Date of Patent: Jun. 19, 2012

(54) PLATFORM FOR EXTENSION LADDER

(76) Inventor: Denis J. O'Connell, Sr., Concord, NH (US)

( * ) Notice: Subject to any disclaimer, the term of this patent is extended or adjusted under 35 U.S.C. 154(b) by 211 days.

(21) Appl. No.: 12/660,852

(22) Filed: Mar. 5, 2010

(51) Int. Cl.
*E06C 7/16* (2006.01)

(52) U.S. Cl. ..... 182/122; 182/120

(58) Field of Classification Search ..... 182/120, 182/122
See application file for complete search history.

(56) References Cited

U.S. PATENT DOCUMENTS

| | | | | |
|---|---|---|---|---|
| 169,236 | A | | 10/1875 | Case et al. |
| 185,251 | A | | 12/1876 | Mason |
| 198,947 | A | | 1/1878 | Kyle |
| 211,389 | A | | 1/1879 | Ellicott |
| 221,780 | A | | 11/1879 | Clark |
| 248,014 | A | | 10/1881 | Boardman |
| 271,509 | A | | 1/1883 | Nolton |
| 309,435 | A | | 12/1884 | Bodell |
| 335,051 | A | | 1/1886 | Ayres |
| 352,716 | A | | 11/1886 | Slack |
| 362,747 | A | | 5/1887 | Higgins |
| 407,079 | A | | 7/1889 | Laskey |
| 446,682 | A | | 2/1891 | Holmes |
| 510,194 | A | | 12/1893 | Sellers |
| 606,763 | A | | 7/1898 | Lukens |
| 686,159 | A | | 11/1901 | Sprague |
| 743,899 | A | | 11/1903 | Lynch |
| 812,620 | A | | 2/1906 | Van Alstine |
| 960,565 | A | | 6/1910 | Levander |
| 966,852 | A | | 8/1910 | Norton |
| 1,112,511 | A | | 10/1914 | Winn |
| 1,216,214 | A | | 2/1917 | Connell |
| 1,245,958 | A | | 11/1917 | O'Connor |
| 1,285,817 | A | * | 11/1918 | Sklar ..... 182/120 |
| 1,462,086 | A | | 7/1923 | Echlin |
| 1,487,243 | A | | 3/1924 | Jackson |
| 1,735,003 | A | | 11/1929 | Heidel |
| 1,820,315 | A | | 8/1931 | Miller |
| 1,920,552 | A | | 8/1933 | Dollerhide |
| 1,943,626 | A | | 1/1934 | Richard |
| 1,981,423 | A | | 11/1934 | Lebre |
| 2,104,987 | A | | 1/1938 | Harding |
| 2,174,891 | A | | 10/1939 | Maran |
| 2,282,133 | A | | 5/1942 | Horton |
| 2,415,289 | A | | 2/1947 | Jury |
| 2,439,185 | A | | 4/1948 | Patt |
| D155,566 | S | | 10/1949 | Agricola |
| 2,486,783 | A | | 11/1949 | Hartman et al. |
| 2,500,559 | A | | 3/1950 | Miller |
| D169,236 | S | | 4/1950 | Simon |
| 2,641,511 | A | | 6/1953 | McClure |
| 2,730,412 | A | * | 1/1956 | Yoder ..... 182/120 |
| 2,772,927 | A | | 12/1956 | Woodward |
| 2,801,886 | A | | 8/1957 | Peterson |
| 2,802,702 | A | | 8/1957 | Rose |
| 2,871,067 | A | | 1/1959 | Brogdon |

(Continued)

*Primary Examiner* — Alvin Chin Shue
(74) *Attorney, Agent, or Firm* — Daniels Patent Law PLLC; Scott A. Daniels

(57) ABSTRACT

A platform for an extension ladder comprises a plate member adapted to engage a pair of rails on each of a first stage and a second stage of the extension ladder and become wedged therebetween and to remain parallel to the ground when the plate member rests on a rung of the extension ladder. The plate member has at least six sides, a bottom cutout, a middle cutout and a top cutout; each cutout oppositely disposed on at least six sides; and each cutout relating to various positions along a length of the extension ladder.

16 Claims, 5 Drawing Sheets

U.S. PATENT DOCUMENTS

| | | | | | |
|---|---|---|---|---|---|
| 2,876,047 | A | | 3/1959 | Plante | |
| 2,948,349 | A | | 8/1960 | Reddy | |
| 2,992,490 | A | * | 7/1961 | Hay et al. | 33/528 |
| 3,067,836 | A | | 12/1962 | Carnicelli | |
| 3,111,193 | A | * | 11/1963 | McKinnie | 182/22 |
| 3,294,197 | A | | 12/1966 | Kwiatkowski | |
| 3,503,468 | A | | 3/1970 | Taylor, Sr. | |
| 3,511,338 | A | | 5/1970 | Chapman | |
| 3,552,523 | A | | 1/1971 | Berkley | |
| 3,899,045 | A | | 8/1975 | Geisel et al. | |
| 4,016,955 | A | | 4/1977 | Gates | |
| 4,085,819 | A | | 4/1978 | Ohnstad | |
| 4,100,998 | A | | 7/1978 | Marquez | |
| D248,777 | S | | 8/1978 | Spencer et al. | |
| 4,211,307 | A | | 7/1980 | Ethridge | |
| 4,212,371 | A | | 7/1980 | Gaviorno, Jr. | |
| 4,241,807 | A | | 12/1980 | McKenna | |
| 4,303,145 | A | | 12/1981 | Vazquez | |
| 4,331,217 | A | | 5/1982 | Stecklow | |
| 4,401,187 | A | | 8/1983 | Van Patten | |
| 4,425,985 | A | | 1/1984 | Geisel et al. | |
| 4,437,544 | A | | 3/1984 | Anderson et al. | |
| 4,482,030 | A | | 11/1984 | Lincourt | |
| 4,586,586 | A | | 5/1986 | Canals | |
| 4,618,030 | A | | 10/1986 | Campbell | |
| 4,646,878 | A | | 3/1987 | Moyer | |
| 4,687,075 | A | | 8/1987 | Skaggs | |
| 4,770,272 | A | | 9/1988 | Riley | |
| 4,800,988 | A | | 1/1989 | Dunmore | |
| 4,823,911 | A | | 4/1989 | Dore | |
| 4,862,994 | A | | 9/1989 | Hughes, Sr. | |
| 4,909,351 | A | | 3/1990 | Johnson et al. | |
| 4,911,265 | A | | 3/1990 | Skaggs | |
| 4,972,923 | A | | 11/1990 | Krause | |
| 5,044,466 | A | | 9/1991 | Jacobsmeyer, Jr. | |
| 5,052,515 | A | | 10/1991 | Nowlan | |
| 5,056,620 | A | | 10/1991 | Zumwalt et al. | |
| 5,072,808 | A | | 12/1991 | Spalt et al. | |
| 5,094,319 | A | | 3/1992 | Kobasic | |
| 5,191,954 | A | | 3/1993 | Ledford | |
| D334,812 | S | | 4/1993 | Hart et al. | |
| 5,337,857 | A | | 8/1994 | Spalt | |
| 5,388,665 | A | | 2/1995 | Newman | |
| 5,429,205 | A | | 7/1995 | Collins | |
| 5,429,465 | A | * | 7/1995 | Puskas | 411/92 |
| 5,460,241 | A | | 10/1995 | LaBelle | |
| 5,465,809 | A | | 11/1995 | Panicci | |
| D388,883 | S | | 1/1998 | Thivierge et al. | |
| 5,779,208 | A | | 7/1998 | McGraw | |
| 5,836,420 | A | | 11/1998 | Marky, Jr. | |
| 5,975,240 | A | | 11/1999 | O'Brien | |
| 6,109,392 | A | | 8/2000 | Merrick | |
| 6,637,548 | B2 | | 10/2003 | Pass | |
| 6,786,300 | B1 | | 9/2004 | Bonifacini | |
| 6,966,406 | B2 | | 11/2005 | Nash, Jr. | |
| 2005/0246914 | A1 | * | 11/2005 | Perea | 33/562 |
| 2007/0240935 | A1 | | 10/2007 | O'Brien et al. | |

* cited by examiner

PLATFORM FOR EXTENSION LADDER

FIELD OF THE INVENTION

This invention relates generally to ladder platforms. More particularly, the present invention relates to a platform that can be removably mounted on a rung of an extension ladder, and mechanically wedged and captured therebetween the rails thereof, to provide increased foot support.

BACKGROUND OF THE INVENTION

The rungs of an extension ladder are typically narrow and very uncomfortable to stand on, particularly when used for extended periods of time by contractors, painters, homeowners and others resulting in aching and tired feet. Furthermore, narrow rungs are dangerous since footing can be compromised when a user moves up and down the extension ladder possibly resulting in falls or injury.

There are numerous prior art devices and methods for use with ladder platforms and work step attachments. Typically, such devices are designed to attach to step ladders and to single fixed stage ladders and can not safely fit between the rails at different widths of an extension ladder which has two or more slidable stages. Furthermore, prior art ladder step attachment devices do not engage or wedge between the side rails of an extension ladder, rather they are directly freely attached to the rung of the ladder making them unstable. These devices have multiple components such as hooks, latches, chains, straps, clamps and other step fastening devices, making them cumbersome to use and costly. Furthermore, the various components often impede work and can disengage from a ladder unwantedly especially if they are not attached properly or if a component fails. Also, the prior art devices due to their design, do not provide sufficient width, depth and surface area to support a user adequately.

The inventor recognized a never before addressed problem and fulfilled a need which overcomes the limitations and issues associated with the above mentioned ladder platforms and work step attachments, with, for example, a platform for an extension ladder that is a single member, without any moving parts, that is adapted to fit stages of an extension ladder.

In view of the above mentioned problems and limitations associated with conventional ladder platforms and work step attachments, it was recognized by the present inventor that there is an unfulfilled need for a ladder platform that is readily adaptable to an extension ladder in lieu of one having multiple attachment components.

Accordingly, it becomes clear that there is a great need for a ladder platform which overcomes the disadvantages and limitations associated with present ladder platforms and work step attachments. Such a ladder platform should be one that works as desired, is safe and easy to use and is economically manufactured.

SUMMARY OF THE INVENTION

It is therefore an object of this invention to provide a platform for an extension ladder which avoids the aforementioned problems of prior art devices.

It is another object of this invention to provide a platform that can be readily adaptable to an extension ladder.

It is another object of this invention to provide a platform constructed as a single member having no moving parts.

It is another object of this invention to provide a platform that can be removably mounted on a rung of an extension ladder, and mechanically captured and wedged therebetween the rails thereof, to provide increased foot support and stability.

It is another object of this invention to provide a platform that can not be unwantedly dislodged from an extension ladder when in use.

It is another object of this invention to provide a platform that is wide and deep enough, with sufficient surface area to comfortably and safely support a user when standing thereon and to remain parallel to the ground when in use.

It is a further object of this invention to provide a platform that can be readily removed and installed at varying locations ranging from the bottom to the top of an extension ladder while working on the extension ladder.

It is a further object of this invention to provide a platform which may be manufactured from readily available materials by conventional manufacturing processes.

It is still a further object of this invention to provide a platform that is simple in design, simple to manufacture, low in cost, safe and is easy and fun to use.

This invention results from the realization that there is a great need for a highly functional platform for an extension ladder; the resulting invention provides such benefits.

According to a first aspect embodying the principles of the invention, disclosed is a platform for an extension ladder comprising a plate member adapted to engage a pair of rails on each of a first stage and a second stage of the extension ladder and become wedged therebetween and to remain parallel to the ground when the plate member rests on a rung of the extension ladder. The plate member having at least six sides, a bottom cutout, a middle cutout and a top cutout; each cutout oppositely disposed on at least six sides; and each cutout relating to various positions along a length of the extension ladder.

The second aspect, in accordance with the present invention, is a special case of the first aspect of this invention with additional features further comprising at least two sides of a plate member having a slot with an angle thereon disposed in close proximity to a middle cutout; the middle cutout adapted to fit between each pair of rails where the first stage and the second stage of the extension ladder converge while cooperating with the slot; the plate member having an angle thereon disposed adjacent each cutout and a handle disposed on one side of the plate member for carrying and for orienting the plate member during installation on the extension ladder.

The third aspect, in accordance with the present invention, is a method for fabricating a platform for an extension ladder.

DETAILED DESCRIPTION OF ILLUSTRATIVE EMBODIMENTS

Figure 1:
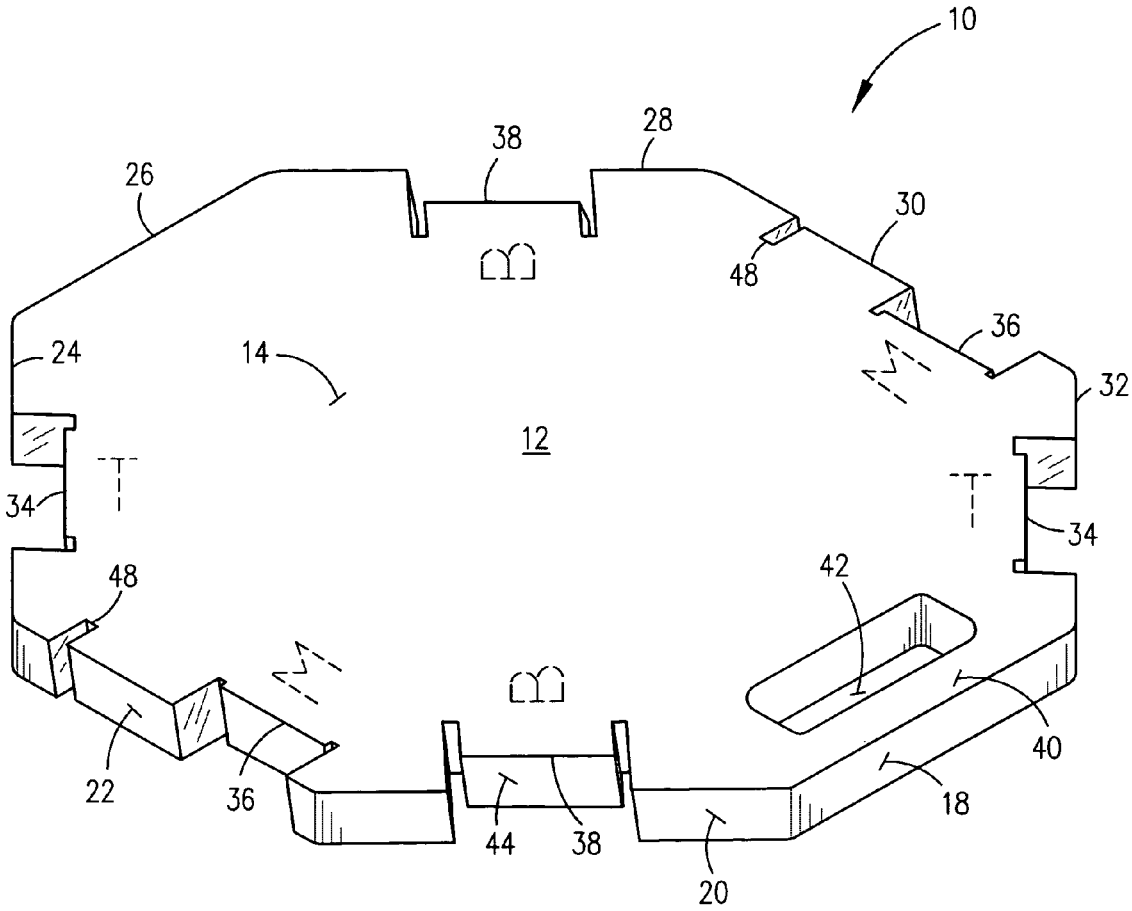
FIG. 1 is a perspective view of an illustrative embodiment of a platform for an extension ladder embodying the principles of the invention.

Looking more particularly to the drawings, there is shown in FIG. 1 an illustrative embodiment of a platform for an extension ladder embodying the principles of the invention, which is generally indicated at 10.

Figure 5:
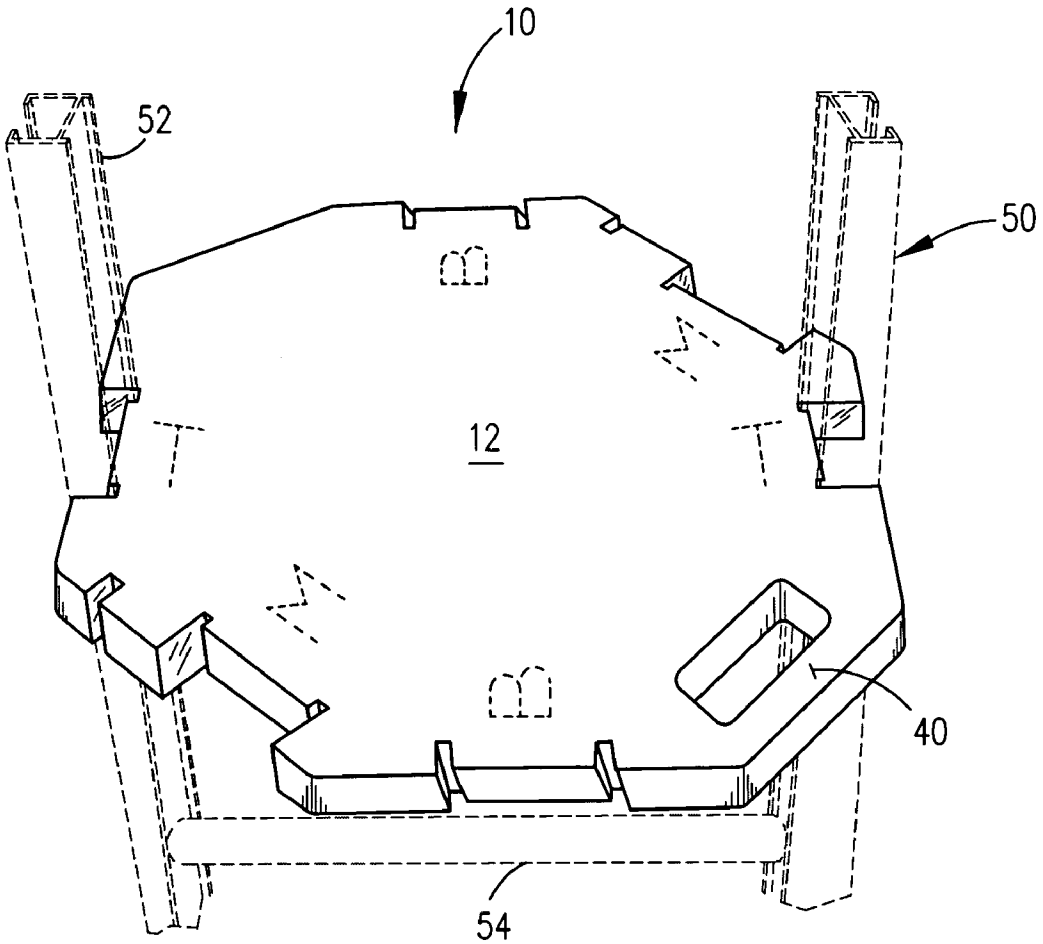
FIG. 5 is a perspective view of the platform of FIG. 1 in use at a top portion of an extension ladder with the extension ladder shown in phantom.
Figure 6:
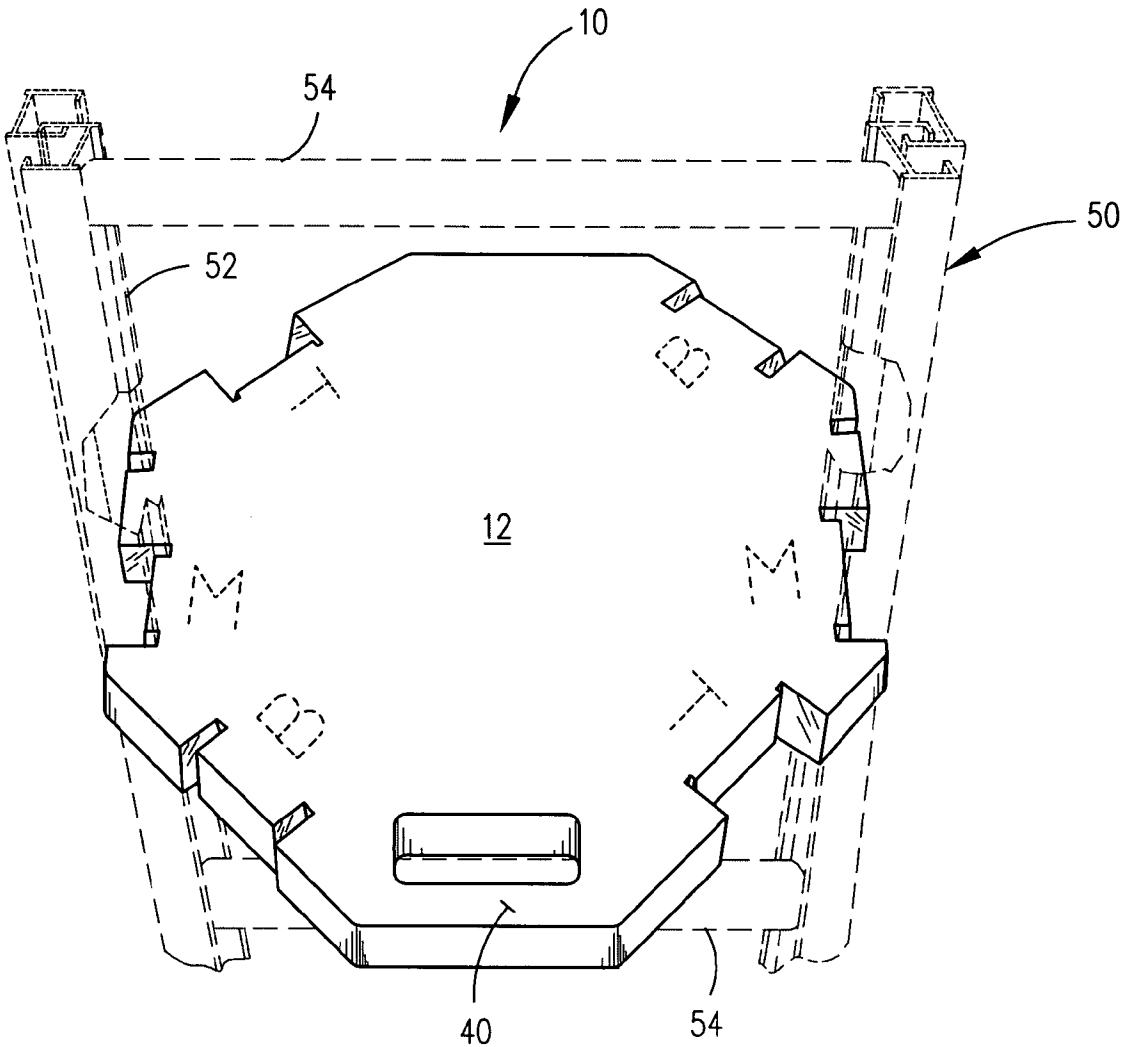
FIG. 6 is a perspective view of the platform of FIG. 1 in use at a middle portion of an extension ladder with the extension ladder shown in phantom.
Figure 7:
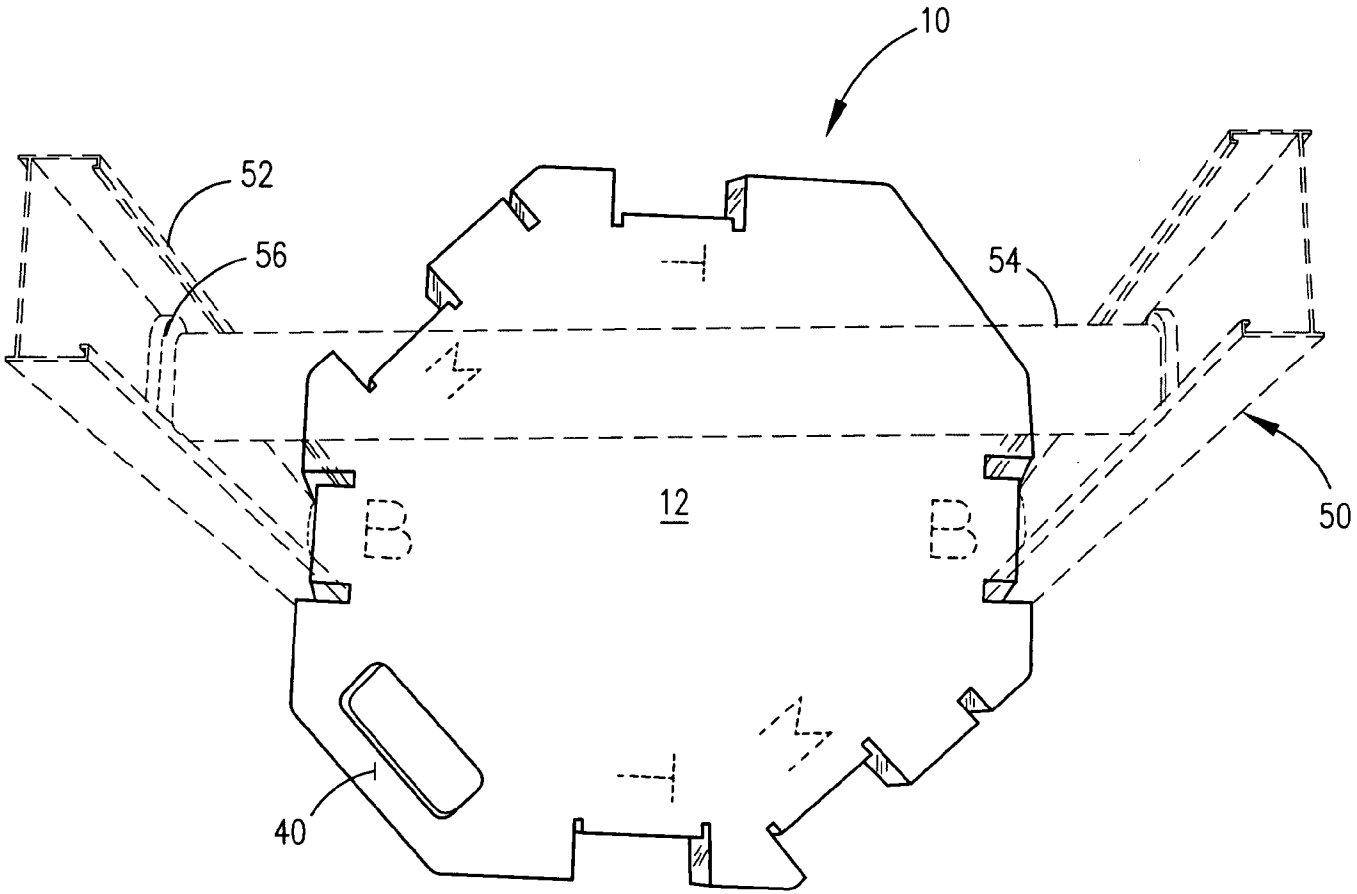
FIG. 7 is a perspective view of the platform of FIG. 1 in use at a bottom portion of an extension ladder with the extension ladder shown in phantom.

FIG. 1 shows a platform 10 for providing comfort to a user when standing on extension ladder 50 seen in FIGS. 5-7. Platform 10 comprising a plate member 12 adapted to engage a pair of rails 52 on each of a first stage and a second stage of extension ladder 50 and become wedged therebetween and to remain parallel to the ground when plate member 12 rests on a rung 54 of extension ladder 50. Plate member 12 having at least six sides, a top cutout 34, a middle cutout 36 and a bottom cutout 38; each cutout oppositely disposed on at least six sides; and each cutout relating to various positions along a length of the extension ladder 50.

The cutouts are further labeled, for convenience "T", "M" and "B" shown in phantom, on a front face 14 of plate member 12 corresponding to the top, middle and bottom sections of extension ladder 50. As an example, plate member 12 has a first side 18, a second side 20, a third side 22, a fourth side 24, a fifth side 26, a sixth side 28, a seventh side 30 and an eighth side 32. Although not necessary for operation, for carrying convenience and for orienting plate member 12 during installation on extension ladder 50, a handle 40 with an opening 42 is formed at first side 18. Bottom cutout 38 is formed at second side 20 and at sixth side 28. Middle cutout 36 and slot 48 are formed at third side 22 and at seventh side 30. As seen in FIG. 6, slot 48 is used to accommodate a second pair of rails 52 when extension ladder 50 is in the extended middle position. Top cutout 34 is formed at fourth side 24 and at eight side 32. Fifth side 26 being unadorned could be further adapted to include additional features, as needed.

At least two sides, for example, third side 22 and seventh side 30 of plate member 12 have slot 48 with an angle thereon disposed in close proximity to middle cutout 36. Middle cutout 36 adapted to fit between each pair of rails 52 where the first stage and the second stage of extension ladder 50 converge while cooperating with slot 48. Top cutout 34 adapted to fit between the pair of rails 52 on the second stage of extension ladder 50. Bottom cutout 38 adapted to fit between the pair of rails 52 on the first stage of extension ladder 50. Plate member 12 having an angle thereon disposed adjacent each cutout.

Figure 2:
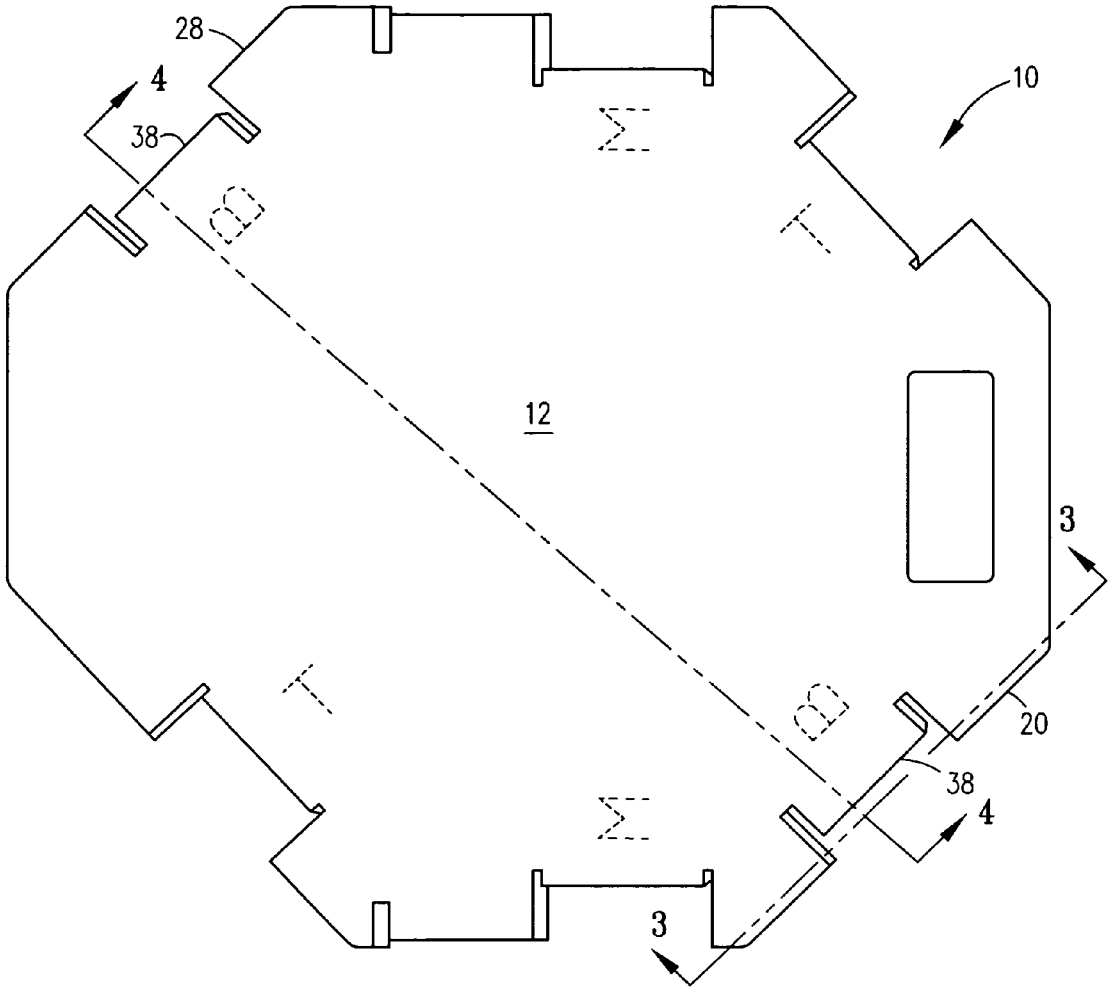
FIG. 2 is a top plan view of the platform of FIG. 1.
Figure 3:
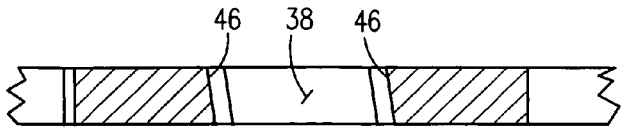
FIG. 3 is a cross sectional view of the platform of FIG. 2 taken along line 3-3.

FIG. 2 is a top plan view of platform 10 of FIG. 1;

FIG. 3 is a cross sectional view of platform 10 of FIG. 2 taken along line 3-3. FIG. 3 illustrates typical cutouts such as, for example, bottom cutout 38 with details for angle 46 of about 15 to 20 degrees allowing platform 10 to be parallel to the ground and for stability when extension ladder 50 is placed against a wall, typically at a ladder manufactures' recommended 75 degree angle, when in use.

Figure 4:
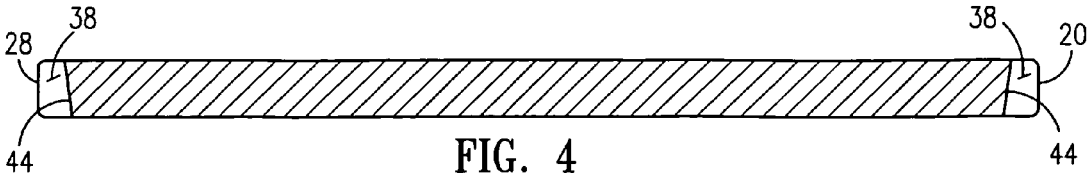
FIG. 4 is a cross sectional view of the platform of FIG. 2 taken along line 4-4.

FIG. 4 is a cross sectional view of platform 10 of FIG. 2 taken along line 4-4. Illustratively shown is second side 20, sixth side 28, bottom cutout 38 and a bevel 44. Aluminum extension ladders typically have a collar 56, such as a weldment, as best seen in FIG. 7, which may cause seating interference when plate member 12 engages rail 52 and rung 54. Bevel 44 relieves this condition and allows plate member 12 to seat properly without interference.

FIG. 5 is a perspective view of platform 10 of FIG. 1 in use at a top portion of extension ladder 50 shown in phantom. In this position, handle 40 is oriented to the right. For convenience, although not necessary for operation, letter "T" shown in phantom, is intended to indicate the desired position of plate member 12 when installed between rail 52 and when disposed on rung 54 when placed on the top portion of extension ladder 50.

FIG. 6 is a perspective view of platform 10 of FIG. 1 in use at a middle portion of extension ladder 50 shown in phantom. In this position, handle 40 is oriented forward. In a manner as above, letter "M" shown in phantom, guides a user to position plate member 12 at the middle position of extension ladder 50. In this position, both stages of extension ladder 50 are captured by middle cutout 36 and by slot 48 as best seen in FIG. 1.

FIG. 7 is a perspective view of platform 10 of FIG. 1 in use at a bottom portion of extension ladder 50 shown in phantom. In this position, handle 40 is oriented to the left. In a manner as above, the letter "B" shown in phantom, guides a user to position plate member 12 at the bottom position of extension ladder 50.

As best seen in FIGS. 5-7, platform 10 may be installed on extension ladder 50 as follows. First a user chooses a particular section of extension ladder 50 where platform 10 is to be used. Next, the user selects one of a pair of cutouts such as 34, 36, or 38 which are further labeled, for convenience "T", "M" and "B", on front face 14 of plate member 12 corresponding to the top, middle and bottom sections of extension ladder 50. Plate member 12 is then positioned between a pair of rails 52 and above any rung 54 on extension ladder 50 by upwardly tilting plate member 12 at an angle of about 45 degrees with a selected cutout adjacently abutting rail 52. Next, plate member 12 is rotated downwardly at an approximately 45 degree angle until the selected cutout engages rail 52 and the opposite selected cutout engages the opposite rail 52 and a bottom surface of plate member 12 contacts a top surface of rung 54. Plate member 12 is thereby securely wedged and mechanically captured by friction between opposing rails 52 and can not be unwantedly dislodged therefrom and remains parallel to the ground and stable when in use. To remove platform 10 from extension ladder 50, plate member 12 is slideably rotated upwardly approximately 45 degrees along one of rail 52 allowing one of the cutouts to disengage from rail 52 so that plate member 12 can be removed. Platform 10 may be re-installed, with one hand and without any tools while standing on extension ladder 50, when a user desires to work at another location along a length of extension ladder 50. Handle 40 may be used to carry platform 10 and to serve as a visual aid for conveniently orienting plate member 12 at various positions. By design, platform 10 can only be installed as desired and as described above. For example, if platform 10 is accidentally inverted by a user, or if a wrong cutout is attempted to be placed on the wrong corresponding position on extension ladder 50, it will not fit, thereby making it impossible to be installed improperly.

To fabricate platform 10, a material is chosen from the group consisting of wood, metal, plastic, fiberglass and a combination thereof. Plate member 12 is adapted therefrom the material to engage a pair of rails 52 on each of a first stage and a second stage of the extension ladder so that plate member 12 become wedged therebetween and to remain parallel to the ground when plate member 12 rests on a rung 54 of extension ladder 50. At least six sides are formed on the plate member 12. A bottom cutout 38, a middle cutout 36 and a top cutout 34 are formed and oppositely disposed at the at least six sides of plate member 12. An angle on plate member 12 adjacent each cutout is formed. A slot 48 with an angle thereon disposed in close proximity to middle cutout 36 is formed on at least two sides of plate member 12. A handle 40 may be formed on one side 18 of plate member 12.

Platform 10, in the illustrative embodiment, may be fabricated by conventional manufacturing methods. Although not necessary for operation, it is understood that front face 14 of plate member 12 may have non-slip materials thereon such as sand, epoxy, rubber or a wide variety of patterns such as embossments to provide additional traction by increasing friction without departing from this disclosure. Also, various patterns such as, but not limited to, diamond shapes, squares and cross hatches, may be embossed on front face 14 for the same reason. Furthermore, indicia, logos, color indicators or embossed indicia may be disposed on plate member 12 to visually aid in placement on extension ladder 50. Embossments may further serve to reinforce and stiffen the structural integrity of platform 10, as needed, thereby permitting use of light weight materials.

Example

The inventor has constructed, and successfully tested platform 10, according to the teachings embodying the principles of the invention. A plate member 12, adapted to fit extension ladder 50, was fabricated of wood with dimensions of about 18 inches by 17 inches at its widest dimension and approximately 1 inch thick and had eight sides. Opposing sides were parallel, but not all sides were equal in length, not even opposing sides. Although not necessary for operation, sand grains were disposed on front face 14 to provide an increased friction surface. Also not necessary for operation, for carrying convenience and for visual orientation, a handle 40 was provided. The inventor recognized that a wide variety of materials can be used in constructing platform 10. The inventor also constructed a six sided platform which worked well from which it is evident that dimensions could vary without departing from this disclosure.

Surprisingly, the instant invention provides an added advantage and recognizes a problem and adequately and completely addresses an unfulfilled need, in that platform 10 in the manner disclosed, in effect, defines a highly functional and useful apparatus that is not presently available. This is due entirely to the particular way the applicant designed and fabricated platform 10 disclosed herein which are not found or taught in the prior art. By doing so, the applicant is able to use inexpensive materials in the fabrication without sacrificing performance, rather, achieving superior unexpected results, due to the particular construction which is cost effective.

One practical advantage of the invention is that it provides a convenient, practical, low cost, platform 10 which allows a user to comfortably work on an extension ladder 50. Another advantage is that platform 10 is wedged and captured between rails 52 at various locations along a length of extension ladder 50 making it very stable and thereby resulting in a substantially greater working surface area than conventional prior art devices. A further advantage is that platform 10, is designed as a single piece, without a need for attachment components, for ease of manufacture by standard methods and by using readily available materials particularly chosen for the problem solved. Surprisingly, the handle 40, besides as a carrier, also serves as an orienting guide for positioning platform 10 on the extension ladder 50.

Of course, a wide variety of further uses and advantages of the present invention will become apparent to one skilled in the art. As disclosed, it is apparent that one skilled in the art will realize that the foregoing discussion outlines the more important features of the invention to enable a better understanding of the embodying principles of the instant invention and to instill a better appreciation of the inventor's contribution to the art. It must be clear that the disclosed details of construction, descriptions of geometry and illustrations of inventive concepts are mere examples of possible manifestations of the invention.

Although the invention has been shown and described with reference to certain illustrative embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A platform system for supporting a load, said platform system comprising:

a plate member having a substantially planar top surface and bottom surface adapted to engage a pair of rails on each of a first stage and a second stage of the extension ladder and become wedged therebetween and to remain parallel to the ground when said plate member rests on a rung of the extension ladder;

said plate member having at least six sides, a first side having a first bottom cutout oppositely disposed to a second side having a second bottom cutout, a third side having a first middle cutout oppositely disposed to a fourth side having a second middle cutout and a fifth side having a first top cutout oppositely disposed to a sixth side having a second top cutout and;

each said cutout relating to various positions along a length of the extension ladder; and wherein the first and second bottom cutouts are defined by an edge of the plate member extending between the top surface and the bottom surface of the plate member formed at a non-perpendicular angle relative to the top and bottom surfaces allowing the plate member to be parallel to the ground when engaged with the extension ladder leaning against a wall.

2. The platform system of claim 1 wherein said first and second bottom cutouts are adapted to fit between the pair of rails on the first stage of the extension ladder.

3. The platform system of claim 1 wherein the non-perpendicular angle is about 15 to 20 degrees relative to perpendicular between the top and bottom surface of the plate member.

4. The platform system of claim 3 wherein said middle cutout adapted to fit between each pair of rails where the first stage and the second stage of the extension ladder converge while cooperating with the slot.

5. The platform system of claim 1 wherein said first and second top cutouts are adapted to fit between the pair of rails on the second stage of the extension ladder.

6. The platform system of claim 1 wherein said plate member is fabricated from a material chosen from the group consisting of wood, metal, plastic, fiberglass and a combination thereof.

7. The platform system of claim 1 wherein said plate member has eight sides.

8. The platform system of claim 1 further comprising a carrying means said plate member and means for orienting said plate member during installation on the extension ladder.

9. The platform system of claim 8 wherein said carrying means comprises a handle disposed on one side of said plate member.

10. The platform system of claim 9 wherein said handle is oriented left when said bottom cutout engages the pair of rails on the first stage of the extension ladder.

11. The platform system of claim 9 wherein said handle is oriented to the front when said middle cutout engages each pair of rails where the first stage and the second stage of the extension ladder converge.

12. The platform system of claim 9 wherein said handle is oriented right when said top cutout engages the pair of rails on the second stage of the extension ladder.

13. A platform system for supporting a load, said platform system comprising:

an extension ladder supporting a plate member adapted to engage a pair of rails on each of a first stage and a second stage of the extension ladder and become wedged therebetween and to remain parallel to the ground when said plate member rests on a rung of the extension ladder;

said plate member having at least six sides; at least two sides of said plate member having a slot;

a first and second side having a respective first and second middle cutout adapted to fit between each pair of rails where the first stage and the second stage of the extension ladder converge while cooperating with the slot;

a third and fourth side having a respective first and second top cutout adapted to fit between the pair of rails on the second stage of the extension ladder;

a fifth and sixth side having a respective first and second bottom cutout adapted to fit between the pair of rails on the first stage of the extension ladder; and said plate member having an angle thereon disposed adjacent each said cutout; and wherein the first and second bottom cutouts are defined by an edge of the plate member extending between the top surface and the bottom surface of the plate member formed at a non-perpendicular angle relative to the top and bottom surfaces allowing the plate member to be parallel to the ground when engaged with the extension ladder leaning against a wall.

14. The platform system of claim 13 wherein the non-perpendicular angle of the edge of the plate member is about 15 to 20 degrees.

15. The platform system of claim 13 wherein said plate member has eight sides.

16. The platform system of claim 13 further comprising a handle disposed on one side of said plate member for carrying and for orienting said plate member during installation on the extension ladder.

* * * * *